US008904723B2

(12) United States Patent
Alonso et al.

(10) Patent No.: US 8,904,723 B2
(45) Date of Patent: Dec. 9, 2014

(54) CORNER GUARD

(71) Applicants: David Alonso, El Cajon, CA (US); Noemi Alonso, El Cajon, CA (US)

(72) Inventors: David Alonso, El Cajon, CA (US); Noemi Alonso, El Cajon, CA (US)

( * ) Notice: Subject to any disclaimer, the term of this patent is extended or adjusted under 35 U.S.C. 154(b) by 0 days.

(21) Appl. No.: 13/903,930

(22) Filed: May 28, 2013

(65) Prior Publication Data

US 2013/0312344 A1 Nov. 28, 2013

Related U.S. Application Data

(60) Provisional application No. 61/651,813, filed on May 25, 2012.

(51) Int. Cl.
*E04B 2/00* (2006.01)
*E04F 19/02* (2006.01)

(52) U.S. Cl.
CPC ..... *E04F 19/028* (2013.01); *E04F 19/022* (2013.01)
USPC ..... 52/287.1; 52/288.1

(58) Field of Classification Search
CPC ..... E04F 19/028; E04F 19/022
USPC ..... 52/287.1, 288.1
See application file for complete search history.

(56) References Cited

U.S. PATENT DOCUMENTS

| | | | | |
|---|---|---|---|---|
| 3,717,968 | A * | 2/1973 | Olsen et al. | 52/288.1 |
| 4,852,318 | A * | 8/1989 | Anderson | 52/288.1 |
| 5,313,754 | A * | 5/1994 | Jensen | 52/255 |
| 6,631,600 | B2 * | 10/2003 | Schiedegger et al. | 52/658 |
| 2005/0000177 | A1 * | 1/2005 | Dugger | 52/272 |
| 2014/0165485 | A1 * | 6/2014 | Gaudreau et al. | 52/287.1 |

* cited by examiner

*Primary Examiner* — Mark Wendell
(74) *Attorney, Agent, or Firm* — Donn K. Harms

(57) ABSTRACT

A corner guard for protecting wall junctions adjacent uneven support surfaces such as a stair and floor surface is provided. The corner guard in an as-used position with first and second leg members extending upright from a floor and an adjacent second surface at a higher elevation such as a stair, protects the wall surfaces intersecting from a first wall surface extending above the floor and a second wall surface extending from the higher second wall surface from impacts and abrasions such as a hose being pulled around the corner at the intersection of the first wall surface and second wall surface. Positioning to accommodate differing elevational heights of first and second surfaces is provided by translational engagement of the first and second leg.

16 Claims, 4 Drawing Sheets

CORNER GUARD

This application claims priority to U.S. Provisional Application Ser. No. 61/651,813 filed on May 25, 2012, and is incorporated in its entirety by reference thereto.

BACKGROUND OF THE INVENTION

1. Field of the Invention

The present invention relates to corner guards for projecting wall junctions. More particularly, the disclosed device relates to a removably engageable corner guard having translatable extension sections configured for employment to protect a corner junction having uneven or stepped surfaces such as around a wall corner on a stairway between adjacent stair steps. In addition, the device employs means for engaging a plurality of such device to form partial or full rectangular shapes for engaging around pillars, pylons, columns, and the like, or simply to form a stand alone barrier.

2. Prior Art

Corner guards for wall junctions are employed in residential and commercial buildings to protect the surface structure and aesthetics of a wall junction at a corner. Such devices are conventionally used where abrasive or impacting contact is anticipated with corner surfaces of building walls such as an accidental bump or scrape of a dolly or furniture during transport thereof past the wall surface. Such abrasive impacts often occur when moving furniture, using dollies or carts to transport objects, and scuffing from a person's shoe, the dragging of extension cords or hoses, and many other reasons.

In particular, it is especially well known that professional carpet cleaning services employ heavy duty drain and pressurized hoses which must navigate around corners, doors, and up and down stairs in a serpentine path within the home or building in order for the user to position equipment within the room to be cleaned. During such cleaning sessions, the hose will often come in contact with one if not many of the home's wall corner junctions. This contact inevitably becomes extremely abrasive since the various hoses must be pulled and retracted during repositioning of the cleaning equipment over the course of the job at hand.

Conventionally, in order to prevent damage to the corners at wall junctions, many professional carpet cleaning service providers employ removably engageable corner guards. The guards are conventionally formed with a right angle and include a base portion such that the guard can be placed on the floor at the corner junction. Often these devices are made from plastic or metal such that the hose can easily pass over them as the hose is being drawn to the desire room. The plastic or metal surface of the engaged guard, protects the underlying drywall or other painted or textured wall surface from damage from the contact with the hoses during the job. Other examples of corner guards are found in prior art.

U.S. Pat. No. 3,717,968 to Olsen et. al. teaches a surface mounted wall guard for protecting wall corners which slidably engages onto mounts which are engaged to the wall. U.S. Pat. No. 4,852,318 teaches a corner guard for protecting the lowermost, or baseboard portion of a wall corner. US. Pat. Pub. No. 2005/0000177A1 to Dugger teaches a corner guard having a ledge portion for covering the corner and adjacent baseboard. U.S. Pat. No. 5,313,754 to Jensen teaches a removably engageable corner guard employing magnets.

A common problem with these and similar corner devices, is that they are not adapted for employment around a corner abutting two uneven floor surfaces such as that which occurs at the junction of a floor surface and an adjacent stair step. Often in home and commercial buildings, stairwells or staircases start around a wall corner junction such that the leading edge of the first stair is substantially flush or adjacent with the junction. Therefor, conventional corner guards cannot be employed as they do not accommodate the elevated stair step adjacent the corner. Conventional floor guards require an even positioning between the two protective surfaces or they will tip over. While an adhesive might be employed to hold conventional guards upright, this is not desirable as it will cause staining or marring of the wall surface, and the guard will still not protect the wall at uneven surface areas.

As such, there is a continuing unmet need for a corner guard device which will be held in operational positioning sitting upon two adjacent uneven floor surfaces. Such a device should be configured to protect the wall corner junction from abrasive and impacting contacts from hoses and other equipment which might contact the wall or corner surfaces. Such a device should provide means to engage around a corner and adjacent stair steps and protect the underlying wall with translatable portions to allow the user to selectively adjust the protective surfaces of the device, for varying elevations of many types of stair steps.

The forgoing examples of related art and limitations related therewith are intended to be illustrative and not exclusive, and they do not imply any limitations on the invention described and claimed herein. Various limitations of the related art will become apparent to those skilled in the art upon a reading and understanding of the specification below and the accompanying drawings.

SUMMARY OF THE INVENTION

The device herein disclosed and described provides a solution to the shortcomings in prior art and achieves the above noted goals through the provision of an adjustable corner guard device configured for support upon uneven support surfaces such as between a floor and stair surface which occurs and to protect the adjacent wall and corner surfaces from abrasion and impacts which are anticipated to occur during carpet cleaning or moving of furniture.

In accordance with one preferred mode, the device is formed from two planar portions joined at substantially a right angle. One or both of the planar portions also include a translatably engaged planar leg member engaged at a first end which can be selectively adjusted to vary the height of the planar portion(s) relative adjacent support surface, such as the floor. Means for translational engagement can be accomplished by forming an interior cavity within the body of the planar portion, wherein the cavity has an opening aperture and internal cavity configured to slidably receive the planar leg. The leg may then be translated either into or a distance out of the cavity to the desired position/height. The position of the leg can be secured via frictional engagement, locking ridges, or other means which become apparent to one skilled in the art.

The device can thus easily be engaged at a wall corner junction communication between a floor surface at one elevation and having an adjacent stair step at a higher elevation. This is accomplished by a positioning of one planar portion supported in an upright position on the lower positioned floor, while adjustable leg of the traverse planar portion can be translated to the floor height of the adjacent elevated stair step. The device may thus be engaged on the landing of the first stair step on the stair side of the corner, which is elevated above and positioned substantially 90 degrees to the lower elevation of the floor on the wall side of the corner.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the invention to provide a corner guard for employment on wall corner junctions adjacent to uneven floor surfaces having at least one adjacent stair step.

It is another object of this invention to provide such a device for wall corners at stair and floor junctions, which employs one or a plurality of slidably engaged portions allowing adaptation of the device to a plurality of uneven surfaces which may vary with each use.

These and other objects of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive examples of embodiments and/or features. It is intended that the embodiments and figures disclosed herein are to be considered illustrative rather than limiting. In the drawings.

Figure 2:
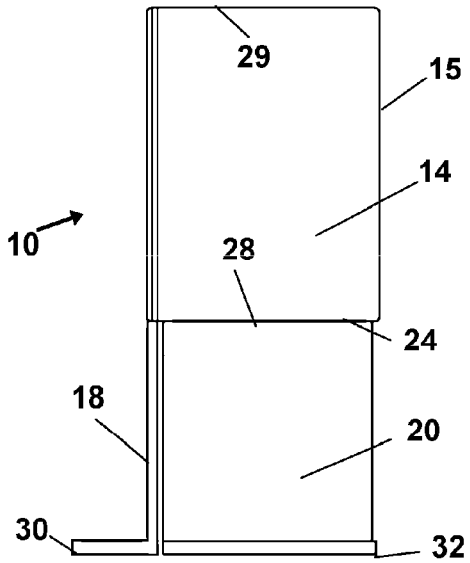
FIG. 2 shows an opposite side view of the mode of the device of FIG. 1.
Figure 2A:
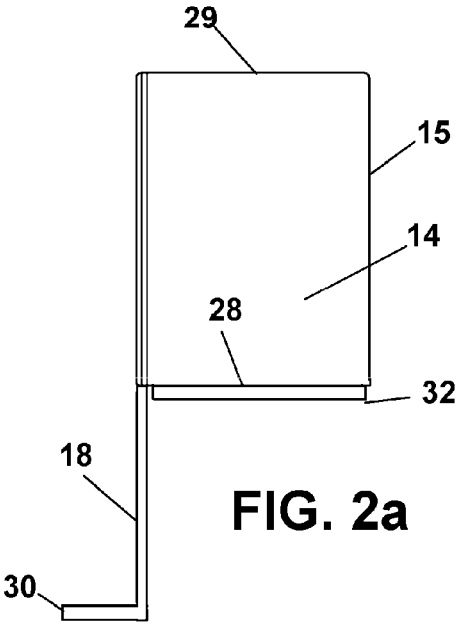

FIG. 2*a* shows a view of another mode of the device having one translationally engaged leg portion and one fixed leg portion.

Figure 1:
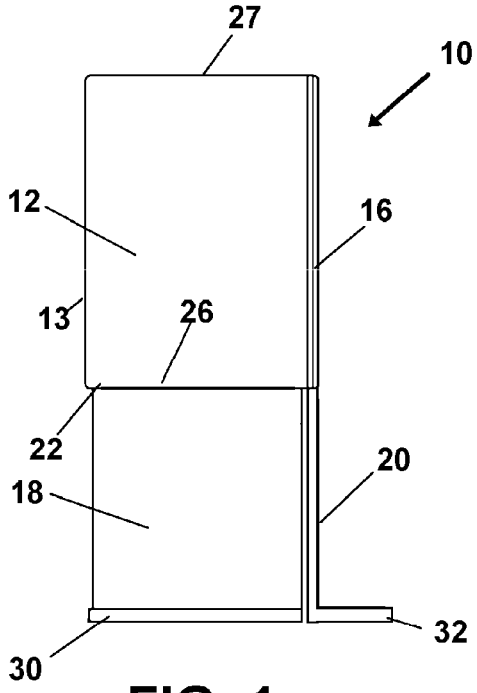
FIG. 1 shows a first side view of a particularly preferred mode of the corner guard invention having a plurality of translationally engaged leg portions.
Figure 3:
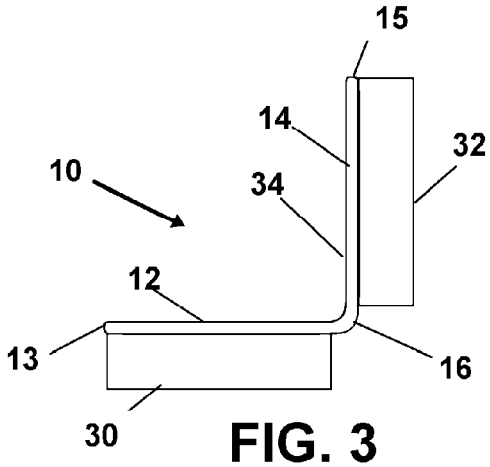

FIG. 3 shows a top view of FIG. 1.

Figure 3A:
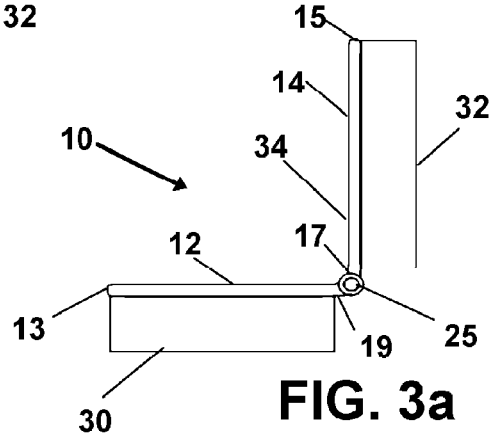

FIG. 3*a* depicts a mode of the device having a hinged engagement allowing rotation of the two planar sides for junction angles other than 90 degrees.

FIG. 4 shows again the first side view of the device showing the cavity for receiving the translationally and frictionally engaged leg member therein which is depicted as a dashed line.

Figure 4:
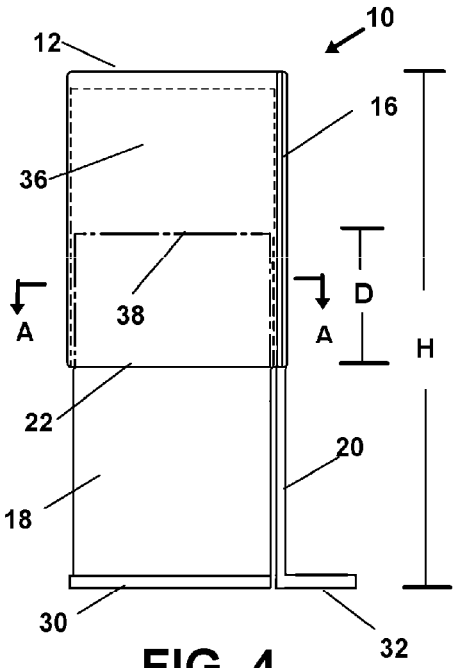
Figure 5:
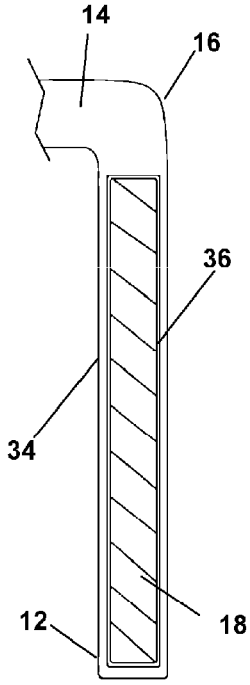

FIG. 5 shows a cross sectional view of FIG. 4 as viewed from line AA of FIG. 4.

Figure 5A:
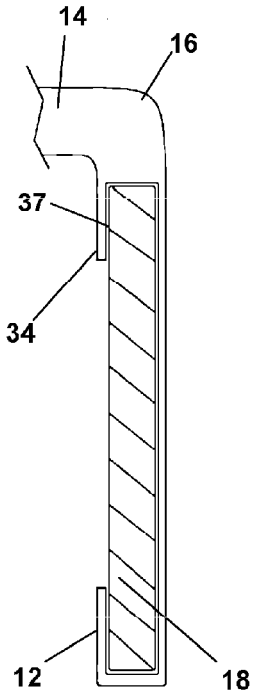

FIG. 5*a* shows a cross sectional view of yet another mode of the slidable engagement of the leg member.

Figure 5B:
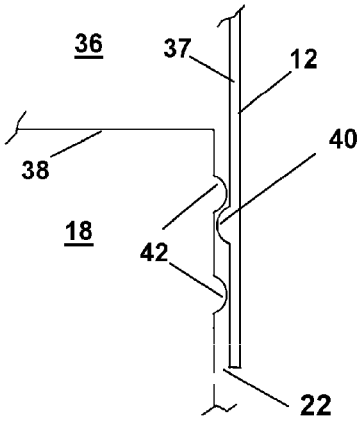

FIG. 5*b* shows a view of another preferred means to secure the position of the leg member employing locking ridges.

Figure 6:
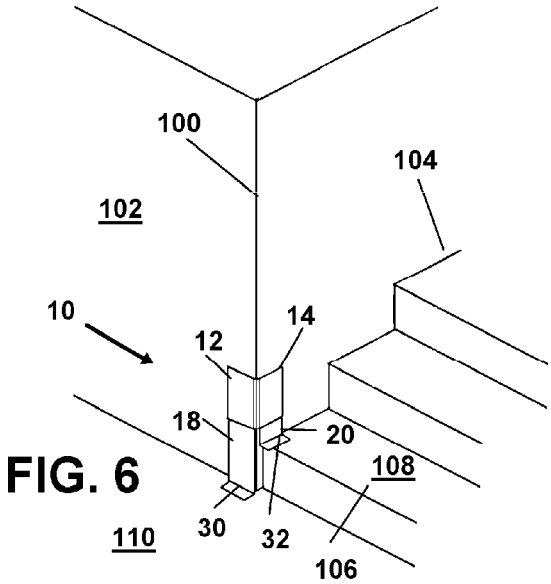

FIG. 6 shows the device in the as used mode positioned on a wall corner junction having an adjacent stair step.

Figure 7:
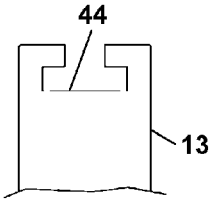

FIG. 7 shows a detailed view of the one terminating edge of the device having a T-shaped groove providing a means for interlocking a plurality of the devices.

Figure 8:
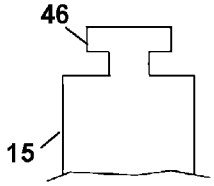

FIG. 8 shows a detailed view of another terminating edge of the device having a complimentary T-shaped tongue protrusion providing a means for interlocking a plurality of the devices.

Figure 9:
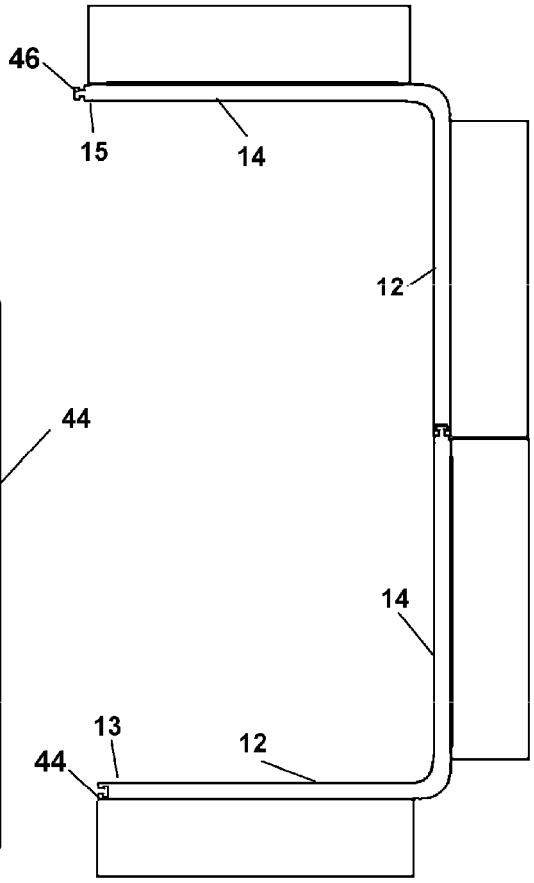

FIG. 9 shows the device as used employing the tongue and groove engagement at the terminating edges for interlocking a plurality of the same.

Figure 10:
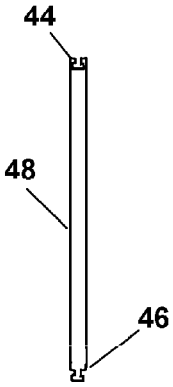

FIG. 10 shows a top view of an additional planar component also employing complimentary tongue and groove removable engagement means which can be engaged between the plurality of engaged device for increasing the spacing therebetween, as needed.

Figure 11:
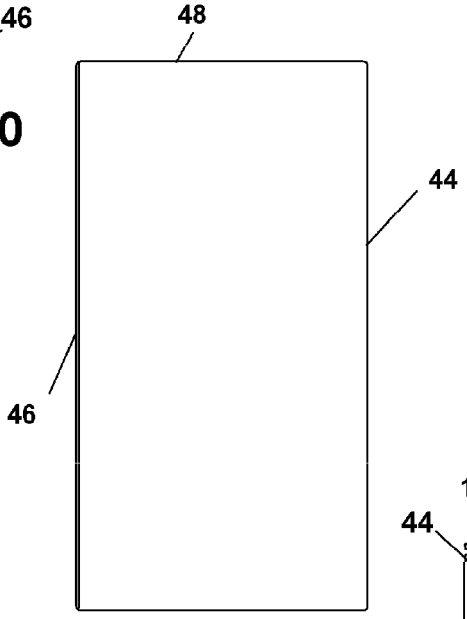

FIG. 11 shows a front view of the planar component.

Figures 12, 13:
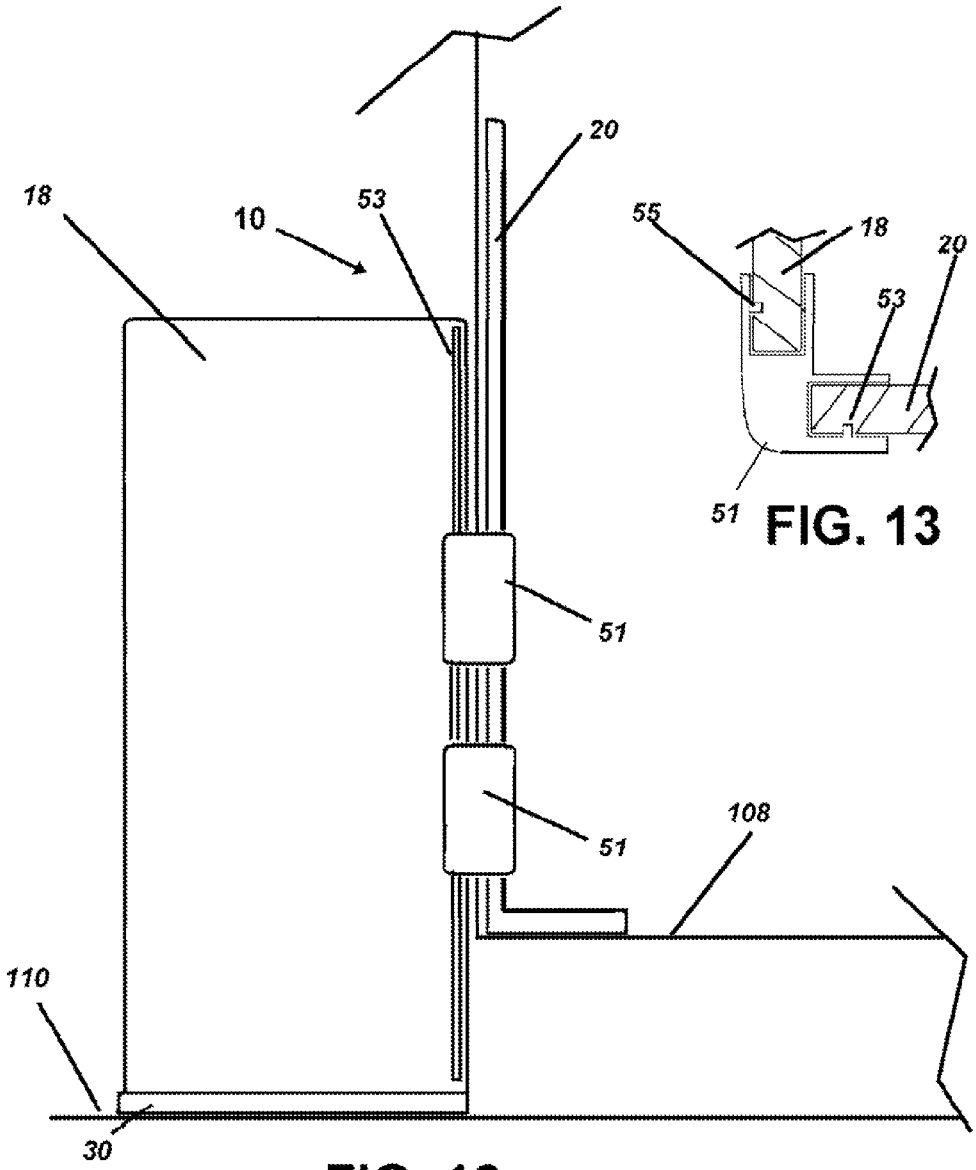

FIG. 12 depicts the device with at least one clip engaging the first and second planar components at a traverse angle to each other.

FIG. 13 shows a sectional view through a clip showing the translational engagement of clip and planar components allowing for the uneven traverse positioning of the two to protect a corner.

DETAILED DESCRIPTION OF THE PREFERRED EMBODIMENTS OF THE INVENTION

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Now referring to drawings in FIGS. 1-13, wherein similar components are identified by like reference numerals, there is seen in FIG. 1, FIG. 2, and FIG. 3 views of a particularly preferred mode of the corner guard device 10. The device 10 is intended for employment on a wall corner junction between a first support surface or floor surface at one elevation, and a second adjoining surface or stair step surface adjacent the junction which is at a higher elevation than the first or floor surface.

The various components of the device 10 disclosed herein can be formed of conventional materials such as plastic or metal however can be formed of any material suitable for the purposes set forth in this disclosure and as would occur to those skilled in the art.

The device 10 includes a means for engagement of the first planar leg member 18 and second planar leg member 20 in an angled positioning relative to each other extending from a junction point which situates adjacent to a corner to be protected.

One mode of angled positioning of the two planar leg members relative to each other employs a first planar portion 12 and a second planar portion 14 which extend at an angled positioning at an angle traverse to the axis of each to the other. Shown herein, at a substantially right angle junction 16 to respective terminating edges 13, 15. However, the junction 16 may instead be in a hinged engagement 25 of the proximal edges 17, 19 opposite the terminating edges 13, 15 allowing means for angle adjustment of the angled positioning of the two engaged leg members 18 and 20, relative to each other, or by a clip 51 or clips 51 shown in FIG. 12. Using such means for angled positioning the two planar leg portions 18 and 20 may be positioned any angle which will provide the positioning of both planar leg surfaces with the axis of each, traverse to the path of the axis of the other, such as at angles between 30 degrees and 140 degrees to each other.

In accordance with a current preferred mode of the device 10, each of the planar portions 12, 14, or clip 51, include a means for translational engagement of both planar leg member 18, and second planar leg member 20 to each other in their mutual engagement thereto. Frictional bias of the translational engagement providing component, and the first leg member 18 and second leg member 20 provides means to maintain the uneven elevation in addition to being placed upon uneven adjoining surfaces.

In use the leg members 18, 20 can be extended or retracted a distance relative the proximal ends 26, and 28, of the planar portions 12, 14, or the two ends of the clip 51, as needed for the intended purpose to be set forth in more detail shortly. The leg members 18, 20 preferably include respective foot members 30, 32, providing a means for supporting each respective leg member 18 and 20 upon adjacent uneven surfaces along with the device 10 in an as-used position as shown in FIGS. 6 and 12 for instance.

Alternatively, as shown in another mode of the invention in FIG. 2*a*, the device 10 can be provided with one translationally engaged leg member 18 and one fixed leg member 20 where only the first leg member 18 translates relative to means for joining the two and the second leg member 20. In the figure the fixed first leg member is provided by the foot member 32 which is engaged directly to the proximal end 28 of the planar portion 14 providing the means to position the two leg members at an angled positioning relative to each other.

FIG. 3*a* depicts a mode of the device 10 having a hinged engagement 25 of the proximal edges 17, 19 opposite the terminating edges 13, 15, allowing means for rotation of the two planar sides for positioning a angles extending from a junction point, other than 90 degrees such as between 30 and 140 degrees. This rotational engagement for a variable positioning angle may be used with one or two slidable leg members also.

Shown in FIG. 4 and in the cross sectional view of FIG. 5, one means for translational engagement of the first leg member 18 is provided by a cavity 36 formed axially within the body of the planar portion 12. It is noted that the leg member 20 of the second planar portion 14, although not explicitly shown, may be similarly engaged, however in a mirrored fashion, as one skilled in the art will immediately recognize. It is preferred that the cavity 36 is configured to receive the leg member 18 in a manner to impart slight if not moderate frictional engagement about at least two surfaces of either leg member 18, or 20, to provide a means for frictional engagement to maintain the relative position of the first leg 18 to the second leg 20, once translated to the desired position for uneven surfaces at an angled positioning by the user.

For descriptive purposes only, in FIG. 4 the outline of the cavity 36 is shown as a continuously dashed line, while the proximal end 38 of the leg member 18 is shown as an intermittently dashed line.

FIG. 5*a* shows another configuration of the planar member 12 providing a means for translational engagement of the first leg member 18 to translation relative to the second leg member 20. In this mode a receiving slot 37 is provided which is configured to frictional engage the leg member 18. The provision of a slot 37 allows a substantial portion of the first surface 34 to be removed as shown, which reduces the amount of material needed to manufacture the device 10 and therefor reduces costs.

Shown in FIG. 5*b* is another mode of the device 10 employing a locking ridge, or protruding member 40 engaged on the wall of the cavity 36 or slot 37. In use the ridge 40 will engage corresponding ridges 42 positioned on the side edges of the first leg member 18 or second leg member 20 as the case may be, which provides a means for secured engagement of the leg member 18 at the desired height. In use the leg member 18 may include a plurality of ridges 42 disposed along the length of at least one side edge, such that the user can translate the leg 18 to the desired position and the engagement of the ridges 40, 42 will maintain the position. It is noted that by forming the various components of the device 10 from plastic, the ridges 40, 42 will simply deflect as the user pulls or pushes the leg 18 to the desired position.

Again referring to FIG. 4, the proximal end 38 of the leg member 18 is positioned a distance D into the cavity 36 corresponding to an overall height H of the device 10. In use, the user can selectively position the first and second leg members 18, 20, at varying heights relative to the positioning of each other on uneven adjoining surfaces, to accommodate a stair step adjacent a wall corner junction.

The cavity 36 is formed into the body of the planar portion 12 extending from an open end 22, 24 located at a proximal end 26,28 of the planar member 12, 14 towards the distal end 27, 29 of planar member 12, 14. Of course the length of the cavity 36 or slot 37 can be varied, along with the length of the leg members 18, 20 to dictate the total extendable length of the device 10.

Shown in FIG. 6 is the device 10 in the as used mode with a first surface 34 engaged to a wall corner junction 100. For descriptive purposes, the junction 100 includes a plain wall side 102 and an adjacent stair set 104. As mentioned, conventional corner guards are not capable of employment in such an environment due to the leading edge 106 of the bottom stair step being flush with, or substantially adjacent to the corner junction 100 at the lower floor surface. As shown, the device 10 allows the user to position the guard 10 at the junction 100 with the first leg 18 extending to an engagement with the lower surface or floor 110 and the second leg member 20 extending to an angled positioning and positional engagement on the second or higher surface of the landing 108 of the first step.

It is noted that the first surface 34 of the device 10 can employ adhesives, magnets, or other means for removable engagement to junction 100 as needed for temporary employment.

In other preferred modes of the invention in FIGS. 7-9, the device 10 employs means for removable interlocking engagement of a plurality of the devices 10, as needed for covering rectangular pillars, pylons, columns, or for forming rectangular barriers. FIG. 7 and FIG. 8 show detailed top views of the terminating edges 13, 15 of the planar portions 12, 14 respectively, employing complementary tongue 46 and groove 44 portions which can be engaged as shown in FIG. 9 providing the means for removable interlocking engagement of the device 10.

FIG. 10 and FIG. 11 shows an optional but preferred planar component 48 which can be employed in combination with the device 10 to increase the size geometry when interlocking the device 10 shown previously in FIG. 9. The terminating edges of the planar component 48 additionally include the complementary tongue 46 and groove 44 portions as the removable interlocking engagement means. In use the planar component 48 can be engaged between adjacent device 10 to form larger geometry guards for engagement around large pillars, columns, and the like.

FIG. 12 depicts the device 10 with at least one clip 51 providing the means for engaging the first and second planar components 18 and 20, to and angled positioning of the two at a traverse angle to each other such as the perpendicular angle shown. However it should again be noted that the angle of positioning of the two planar legs 18 and 20 relative to each other could be at an angle between 30 degrees or 140 degrees extending from the junction point, and the device 10 will still function to protect an adjacent corner, where an uneven surface such as a stair and floor meet. In some instances the lessor or increased angle of the two planar components to each other may be desirable. Consequently, any angle where one planar surface of the device 10 is engaged translatabley to the other planar surface, between 30 degrees and 140 degrees may be used.

Also the clips 51 could number just one or could be a plurality of two or more as shown. If a single clip 51 is employed it may be slightly wider than shown. Also as shown the clip 51, or other means for angled positioning and engagement shown elsewhere herein, engages the two planar members 18 and 20 in a traverse angle to each other, using frictional engagement between the clip 51 and planar surfaces of first leg 18 and second leg 20 sufficient to hold them in a removably fixed uneven engagement as shown in FIG. 12. In the mode shown in FIG. 12, a recess 53 and projection 55 maintain the two planar surfaces engaged to the clip 51.

FIG. 13 shows a sectional view through a clip showing the translational engagement of clip and planar components allowing for the uneven traverse positioning of the two to protect a corner.

It is noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed:

1. A corner guard apparatus for protecting wall junctions adjacent uneven support surfaces such as a stair and floor surface, comprising;

a first leg member having a first planar surface extending between a first distal edge opposite a first proximal edge;

a first supporting edge extending between said first proximal edge and said first distal edge;

a second leg having a second planar surface extending between a second distal edge and a second proximal edge;

a second supporting edge extending between said second proximal edge and said second distal edge;

a junction of said first planar surface in a traverse angle relative to said second planar surface and with said first proximal edge positioned proximate to said second proximal edge;

means for translational engagement of said first leg member to said corner guard;

said first planar surface supportable in an upright position with said first planar surface parallel to an adjacent first wall surface, by said first supporting edge positioned on or adjacent to a first support surface;

said second planar surface supportable in an upright position with said second planar surface parallel to an adjacent second wall surface, by said second supporting edge positioned on a second support surface;

said corner guard having an as-used position with said first planar surface and said second planar surface both in respective said upright positions; and whereby an intersection of an area of said first wall surface extending above said first support surface to an area of said second wall surface extending above said second support surface positioned at an elevation higher than said first support surface, is protected from impact and abrasions thereto, by said corner guard in said as-used position, and a translation of said first leg member provides an adjustment thereto for said corner guard, to accommodate differing said elevations of said second support surface.

2. The corner guard device of claim 1 wherein said means for supporting comprises;

a first foot component engaged at said first supporting edge of said first leg member and extending substantially orthogonally therefrom; and a second foot component engaged at said second supporting edge of said second leg member and extending substantially orthogonally therefrom.

3. The corner guard device of claim 2 wherein said traverse angle is between 30 and 140 degrees.

4. The corner guard device of claim 3 wherein said traverse angle is 90 degrees.

5. The corner guard device of claim 4 wherein said junction comprises a rotational engagement of said first leg to said second leg, and said traverse angle is adjustable.

6. The corner guard device of claim 3 wherein said junction comprises a rotational engagement of said first leg to said second leg, and said traverse angle is adjustable.

7. The corner guard device of claim 3 wherein said means for translational engagement of said first planar leg member to said corner guard comprises:

a frictional engagement of said first leg member to said junction.

8. The corner guard device of claim 2 wherein said junction comprises a rotational engagement of said first leg to said second leg, and said traverse angle is adjustable.

9. The corner guard device of claim 2 wherein said means for translational engagement of said first planar leg member to said corner guard comprises:

a frictional engagement of said first leg member to said junction.

10. The corner guard device of claim 1 wherein said traverse angle is between 30 and 140 degrees.

11. The corner guard device of claim 10 wherein said traverse angle is 90 degrees.

12. The corner guard device of claim 11 wherein said junction comprises a rotational engagement of said first leg to said second leg, and said traverse angle is adjustable.

13. The corner guard device of claim 10 wherein said junction comprises a rotational engagement of said first leg to said second leg, and said traverse angle is adjustable.

14. The corner guard device of claim 1 wherein said junction comprises a rotational engagement of said first leg to said second leg, and said traverse angle is adjustable.

15. The corner guard device of claim 14 wherein said means for translational engagement of said first planar leg member to said corner guard comprises:

a frictional engagement of said first leg member to said junction.

16. The corner guard device of claim 1 wherein said means for translational engagement of said first planar leg member to said corner guard comprises:

a frictional engagement of said first leg member to said junction.

* * * * *